US005095553A

United States Patent [19]

Vosper

[11] Patent Number: 5,095,553

[45] Date of Patent: Mar. 17, 1992

[54] SPILL FREE CLEAN OUT TRAP

[76] Inventor: George W. Vosper, 149 Earl St., Kingston, K7L 2H3, Canada

[21] Appl. No.: 67,808

[22] Filed: Jun. 30, 1987

Related U.S. Application Data

[63] Continuation-in-part of Ser. No. 497,204, May 23, 1983, abandoned.

[51] Int. Cl.[5] ..... F16K 13/00; E03C 1/284

[52] U.S. Cl. ..... 4/191; 137/247.35

[58] Field of Search ..... 4/191; 137/247.35

[56] References Cited

U.S. PATENT DOCUMENTS 1,210,201 12/1916 Perkins ..... 137/247.35

FOREIGN PATENT DOCUMENTS 40292 2/1887 Fed. Rep. of Germany ..... 137/247.35

*Primary Examiner*—Charles E. Phillips

*Attorney, Agent, or Firm*—Lowe, Price, LeBlanc & Becker

[57] ABSTRACT

A spill free cleanout type sink trap that includes a cover sealingly and detachably mounted on a container and respective individual inlet and outlet conduits spaced apart laterally from one another. In one embodiment the conduits both project downwardly below the cover into the container in which case, during use, the water level in the container is spaced from the cover. This is an air space and of sufficient volume as to receive and hold the liquid, normally retained in the conduits, when the seal between the cover and container is broken. In another embodiment, the cover is spaced downwardly from the upper edge of the container whereby during use, the water is confined to the bottom portion of the container. The container above the cover has sufficient volume to receive and hold the liquid normally retained in the conduits when the seal between the cover and the container is broken. A spill free trap is also provided using a combination of the two foregoing features, i.e. having a portion of the liquid free volume internally of the trap and the remaining portion externally of the trap.

9 Claims, 3 Drawing Sheets

SPILL FREE CLEAN OUT TRAP

REFERENCE TO CO-RELATED APPLICATION

This is a Continuation-in-Part of Application Ser. No. 497,204, Filed May 23, 1983 now abandoned.

FIELD OF INVENTION

This invention relates to a spill free clean out trap.

BACKGROUND OF INVENTION

Easy-clean traps for sink drains and the like are known in the art, as exemplified by the teachings in U.S. Pat. Nos. 3,935,602, issued Feb. 3, 1976 to H. D. Kale, 2,742,101, issued Apr. 17, 1956 to C. Stambaugh, and 1,210,201, issued Dec. 26, 1916 to W. H. Perkins. In each instance these traps have a removable lower portion that can be quickly and readily detached to retrieve any foreign objects that may have collected therein. The problem with such traps is that when the bottom is removed, liquid in the pipe spills and this must be collected in a separate container. Removal of the bottom of the trap usually results in a spillage of the liquid in the surrounding area. Cabinets and other enclosures around the sink limit the space and in many instances there is insufficient room to get a container in to collect the liquid in the pipe.

Various types of traps are illustrated in the following references:

United States Patents 4,275,760 issued June 30, 1981 to B. Kessel
4,264,442 issued Apr. 28, 1981 to D. Jackson
4,230,582 issued Oct. 28, 1980 to A. Tuleja
4,158,897 issued June 26, 1979 to M. Cocherel
3,751,734 issued Aug. 14, 1973 to R. Lumadue
3,725,964 issued Apr. 10, 1973 to G. Whitsett
277,888 issued May 22, 1883 to P. Connolly Canadian Patents 39,019 issued May 28, 1892 to J. Carroll
103,102 issued Jan. 6, 1907 to J. Paddon
118,591 issued May 25, 1909 to J. Donovan
218,965 issued May 23, 1922 to E. Johansson

SUMMARY OF INVENTION

An object of the present invention is to provide an improvement to the foregoing such that the liquid in the pipes can be collected without spillage in the removable portion of the trap, thereby resulting in no spillage.

In order to overcome the foregoing disadvantages, applicant has provided a trap wherein there is sufficient liquid free volume in the container of the trap, above the normal water level therein, to collect and hold the liquid in the conduits when the seal is broken between the removable container portion of the trap and the remaining portion.

In keeping with the foregoing, there is provided in accordance with the present invention a trap that includes a container, a cover for the container and a liquid inlet and a liquid outlet separate from one another in the cover and which have connected thereto respective inlet and outlet conduits when mounted in situ, said trap having liquid in the container and respective ones of the inlet and outlet conduits during normal operation, characterized in that the cover and container are detachably interconnected and either (a) the container has a portion that projects upwardly beyond the cover, or (b) the inlet and outlet conduits each extend beyond the cover into the container so that there is always an air space above the liquid in the container or both (a) and (b) as aforesaid such that the container is only partially filled with liquid during normal use leaving additional volume, above the normal liquid level therein, at least equal to the volume of liquid normally retained in the inlet and outlet conduits so as to receive and retain the same when the seal between the cover and container is broken thereby providing a spill free cleanout trap.

BRIEF DESCRIPTION OF THE DRAWINGS

The invention is illustrated by way of example in the accompanying drawings wherein.

DETAILED DESCRIPTION OF PREFERRED EMBODIMENTS

Figure 1:
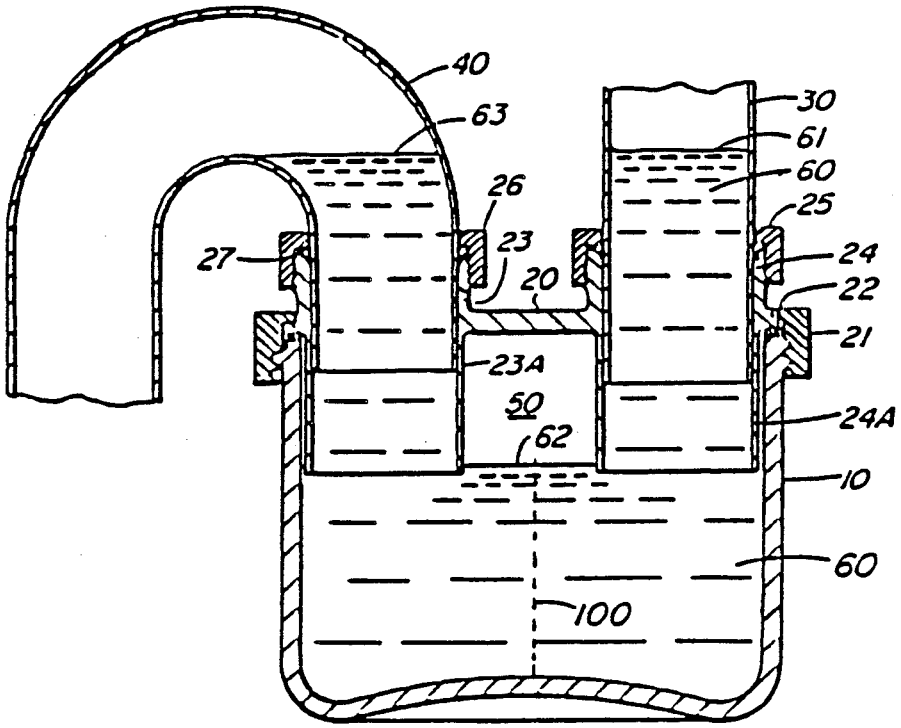
FIG. 1 is a vertical cross-sectional view of a sink trap provided in accordance with the present invention wherein there is an air space in the upper part of the trap.
Figure 2:
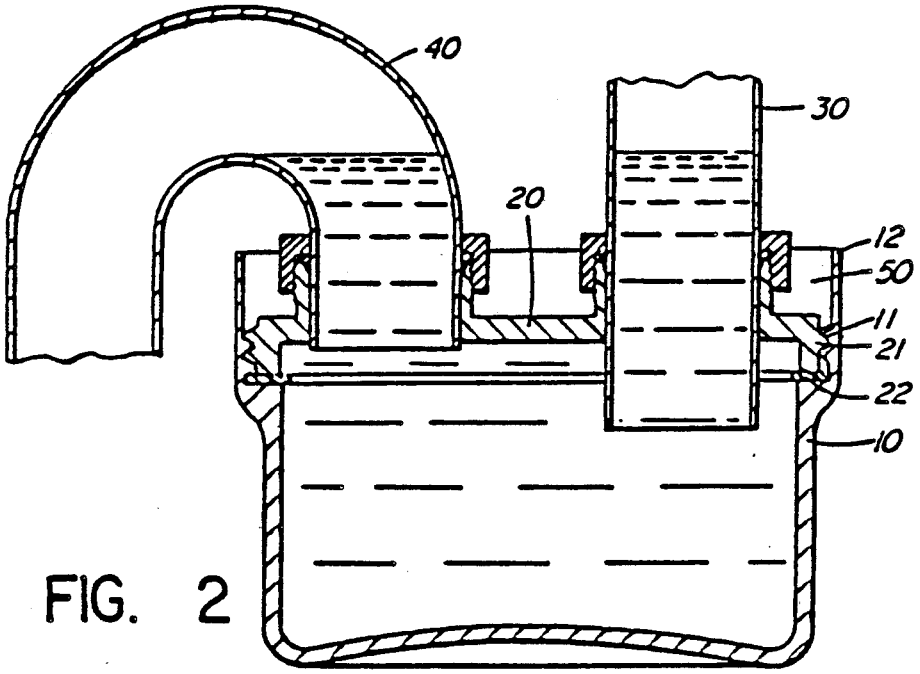
FIG. 2, similar to FIG. 1, illustrates a modification where the container of the sink trap extends above the cover.

Referring to the drawings, there is illustrated in FIGS. 1 and 2, a sink trap comprising a container 10 detachably and sealingly connected to a cover 20. The liquid flow path is through inlet conduit 30 through the container and then through the outlet conduit 40. The direction of travel of the liquid in the inlet conduit is opposite to that in the outflow, the reversal of flow direction effectively taking place in the container. In the embodiment illustrated in FIG. 1, the open end of the conduits 30 and 40 in container 10 are located a selected distance downwardly from the cover (i.e. the upper end of the container) providing a liquid free space 50 in the container above the normal liquid level therein. During normal use of the trap, the liquid 60 has a level designated 61 in the inlet conduit, a level designated 62 in the container and a level designated 63 in the outlet conduit. The liquid free volume 50 in the container, above liquid level 62, is at least equal to and preferably greater than the volume of the portion of liquid 60 contained in the inlet and outlet conduits 30 and 40 above the liquid level 62 so that when the seal between the container 10 and cover 20 is broken, the liquid in the conduits will flow into the volume 50 in the container. This results in collecting all of the liquid in the container with no spillage occurring when removing the container 10 to clean out the trap.

In the embodiment illustrated in FIG. 1, the container 10 is detachably connected to the cover 20 by a threaded ring nut 21 and for sealing purposes there is provided a gasket 22 between the container and the cover. The cover 20 is also provided with threaded spigots 23 and 24 on the upper side of the cover and continuations thereof, designated 23A and 24A, project from the opposite side of the cover downwardly into the container. Conduits 30 and 40 project into respective ones of the spigots 24 and 23 and sealing is provided in a conventional manner by respective ring or gland nuts 25 and 26 having flanges cooperating with packing material 27.

In the embodiment illustrated in FIG. 2, the projecting portions 23A and 24A shown in FIG. 1 are dispensed with and in place thereof inlet and outlet conduits 30 and 40 may, if desired pass through the respective spigots 24 and 23 and project downwardly a selected amount into the container to provide the necessary liquid free space in the upper portion of the container.

FIG. 2 illustrates another embodiment which consists of having the liquid free volume located exteriorly of the trap. As will be noted from FIG. 2, the container 10 is provided with internal threads 11 at a position spaced downwardly from the upper edge 12 of the container so that the volume 50, provided for collecting the excess liquid, i.e. the liquid in the conduits, is located entirely exteriorly of the trap. The cover 20 is provided with external threads 21 that mate with the threads 11 on the container. A gasket 22 is interposed between the lower edge of a peripheral rim on the cover and a ledge on the container. The advantage of this embodiment is that seal 22 need only prevent the egress of liquid from the container as opposed to air. If desired in the FIG. 2 embodiment, inlet and outlet conduits 30 and 40 could project a selected amount into the container such that the liquid free volume is partially interiorly and partially exteriorly of the trap.

In the embodiment illustrated in FIG. 1, the conduits 30 and 40 project preferably an equal amount into the container. Also, if desired, a screen or strainer 100 may be placed in the container to prevent the through flow of accidently dropped possessions. The height of the screen need be no more than the normal water level 62 in the container.

Figure 3:
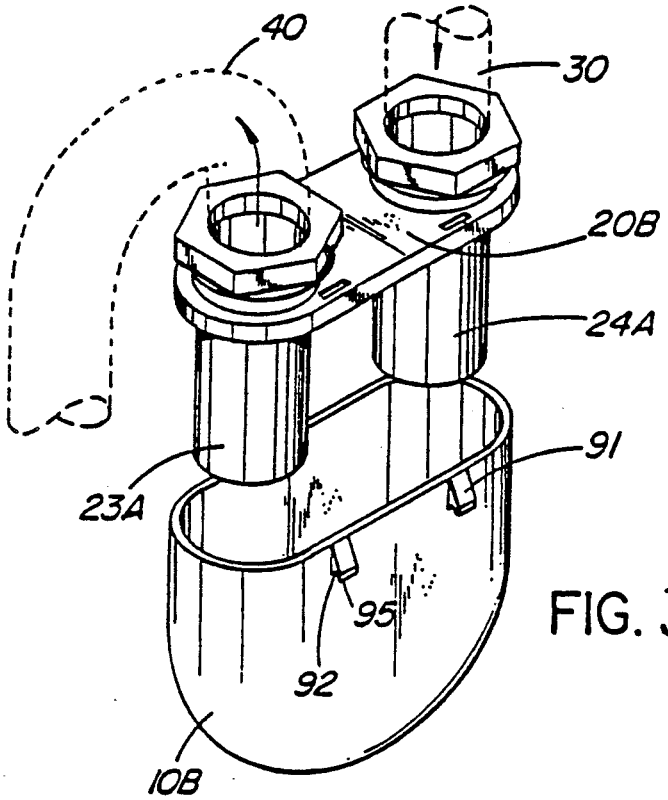
FIG. 3 is an exploded view illustrating minor modifications to the trap.

In the embodiments of FIGS. 1 and 2, the container 10 is circular and in some instances may take up more space than available where it is to be installed. In FIGS. 3, 4, and 6 to 8, there is illustrated an embodiment, with various modifications thereto, wherein the container effectively has flattened sidefaces, minimizing the space required for the trap. Referring to FIG. 3, the sink trap as shown therein comprises a molded plastics container 10B having a cover 20B detachably held thereon by one or more (preferably 2 or 4) over-center draw down clamps 200, (see FIGS. 5 and 8). The container 10B has a lug 91 secured to the wall thereof (or molded integrally therewith) for each clamp. On the lower edge of lug 91 there is a groove 92 for receiving the free end of the latch portion of the draw down clamp (or a shaft on the free end thereof). In the event there is a shaft on the end of the hold down clamp, lip 95 of the groove 92 may be partially flexible so that the shaft can be pressed into the groove and held therein by the lip 95.

The cover 20B has passages therethrough for inflow of liquid into the container and outflow of liquid therefrom through respective conduits 30 and 40 connected to such passages. In the embodiment illustrated spigots 23A and 24A are formed integrally with the cover as in the embodiment illustrated in FIG. 1. Alternatively, the inflow and outflow conduits may project downwardly into the container as per the embodiment illustrated in FIG. 2.

Figure 4:
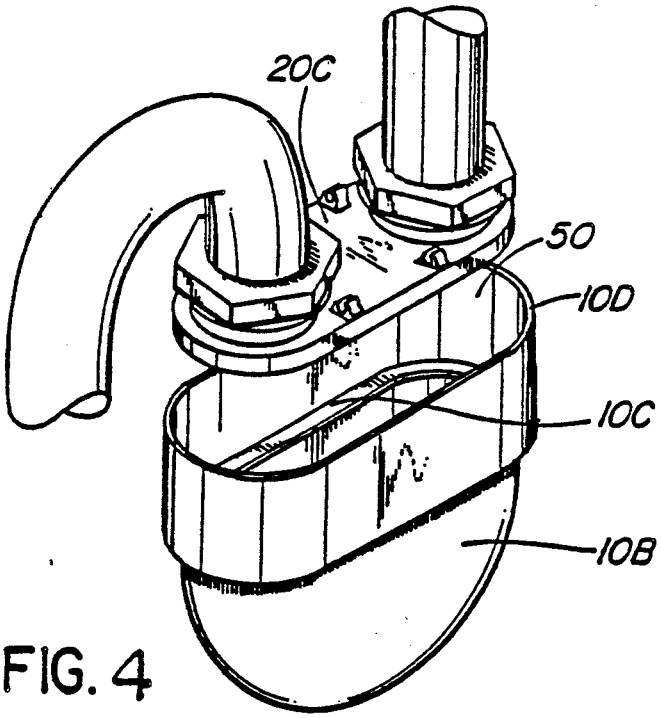
FIG. 4 is a view similar to FIG. 3, illustrating further modifications to the trap.
Figure 5:
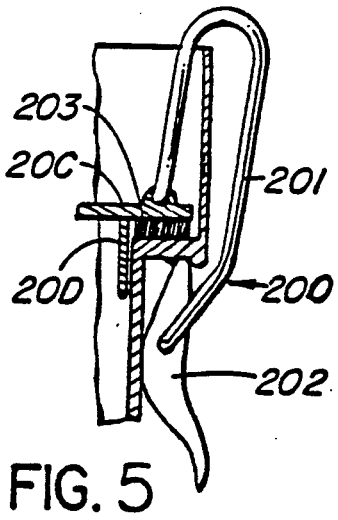
FIG. 5 is a partial cross-sectional view of the trap shown in FIG. 4 when assembled including an over centre hold down clamp.
Figure 6:
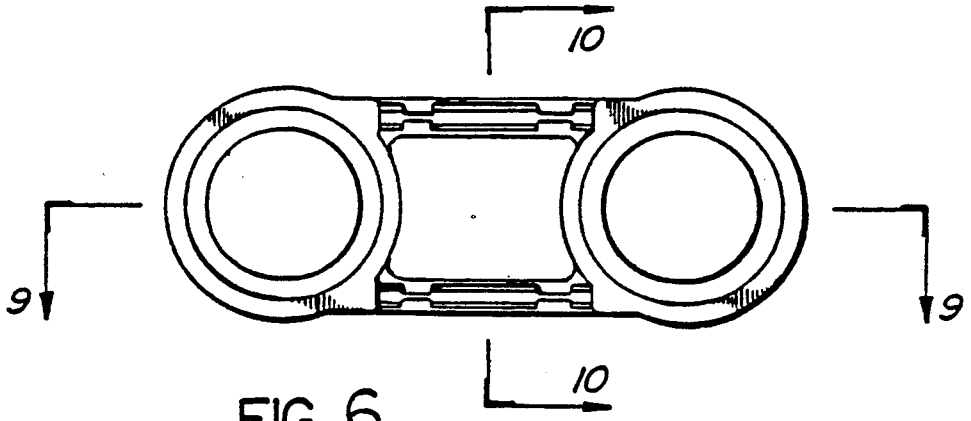
FIG. 6 is a top plan view of a sink trap of the type illustrated in FIG. 4 with further modifications thereto.
Figure 7:
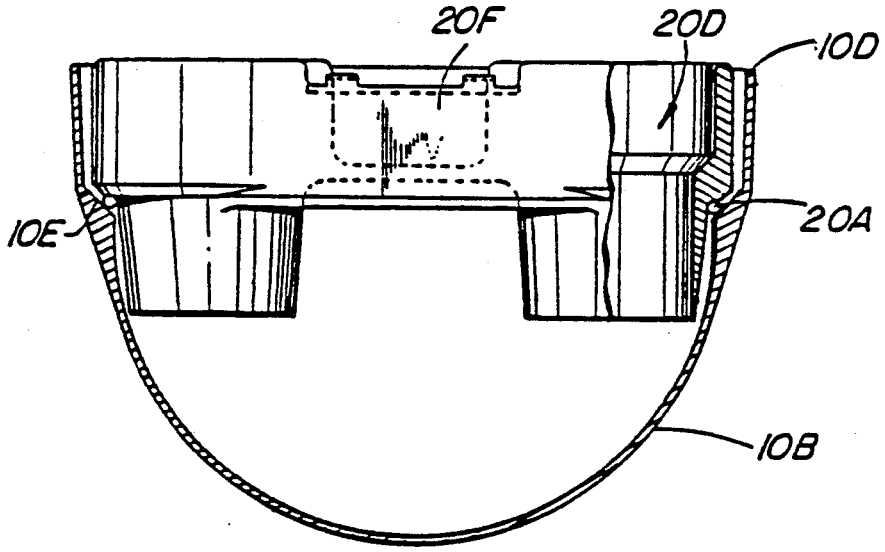
FIG. 7 is a partial cross-sectional view taken essentially along line 9—9 of FIG. 6.
Figure 8:
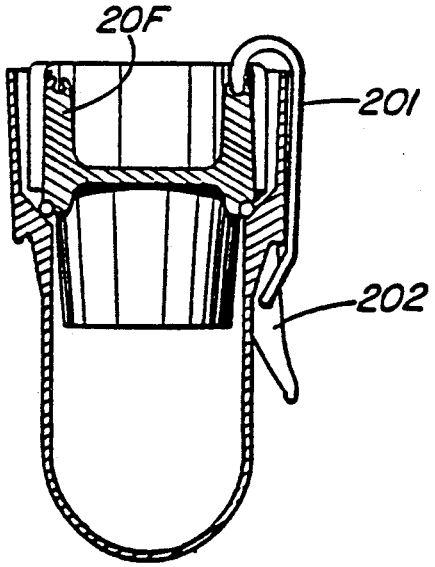
FIG. 8 is a cross-sectional view taken essentially along line 10—10 of FIG. 6, and additionally includes an over-centered clip for holding the components of the trap in an assembled condition.

In the embodiment illustrated in FIG. 4, the container 10B is provided with a ledge 10C, on the internal surface, spaced downwardly from the upper edge 10D of the container so that when the cover is mounted on the container it is spaced downwardly from the upper edge of the container. This provides an embodiment corresponding to the embodiment illustrated in FIG. 2 wherein the additional volume 50 for the container, i.e. liquid free volume, is located exteriorly of the trap. If spigots 23A and 24A are dispensed with, the liquid free volume 50 would be entirely exteriorly of the trap or if short spigots were used then a portion of the liquid free volume would be interiorly of the trap and the remaining portion exteriorly of the trap.

Various constructional details are illustrated in FIGS. 5 to 8 which are believed self-evident therefrom and thus will only be described briefly. It will be noted in FIG. 4 the ledge 10C is flat, while the corresponding ledge 10E in the embodiment illustrated in FIG. 7 slopes inwardly, downwardly into the container. The cover 20C illustrated in FIGS. 4 and 5 has a flange 20D projecting downwardly therefrom into the container reinforcing the cover to evenly distribute the force from the tie-down clamp 200 in compressing the gasket 203 disposed between the cover and the ledge 10C. In the embodiment illustrated in FIG. 7, an O-ring seal 204 is interposed between the sloping shoulder 10E and a groove around the periphery of the cover. The cover designated 20D has upstanding flanges 20F serving as an abutment for the bent-over loop of the tie-down clamp 200 and reinforcement of the cover. The over centre tie down clamp 200 shown in FIGS. 5 and 8 consists of a bent-over loop 201 which pivotally attaches to a latch 202 by way of lugs projecting into respective ones of a pair of apertures in the latch. The latch member 202 is a short length of an extrusion of plastics material having a cross-sectional shape clearly illustrated in FIGS. 5 and 8.

While the improvement has been described herein with reference to drain traps, the same principle can apply to fuel line traps.

The embodiments of the invention in which an exclusive property or privilege is claimed are defined as follows:

1. A fluid spill free clean out type trap comprising an open topped container, a cover detachably secured to said container, and liquid inlet and outlet, means distinct and separate from one another, through said cover at respective locations spaced apart from one another and which, during use of the trap, have connected thereto respective inlet and outlet conduits when mounted in situ, said trap having liquid in the container and respective ones of the inlet and outlet conduits during normal operation, said cover sealingly engaging said container at a position spaced downwardly from the open top thereof whereby the container has a portion that projects upwardly beyond the cover, said container thereby having a volume that is greater than the volume of the fluid receptacle portion of the trap defined by said container and cover attached thereto, said container thereby being only partially filled with liquid during normal use leaving additional volume, above the normal liquid level therein, at least equal to the volume of liquid normally retained in the inlet and outlet conduits so as to receive and retain the same when the seal between the cover and container is broken thus providing a spill free clean out trap.

2. A trap as defined in claim 1 wherein the container is elliptical.

3. A trap as defined in claim 1 wherein the container is cylindrical.

4. A trap as defined in claim 1 wherein said liquid inlet and outlet conduits slip fit into respective ones of a pair of threaded spigots on the cover and including threaded ring nuts and O-ring seals cooperating with the spigots and conduits.

5. A trap as defined in claim 1 wherein the cover and container are threadingly interconnected.

6. In a fluid trap, a fluid receptacle portion defined by a separable container and closure therefore detachably secured thereto, said closure including spaced apart inlet and outlet means for the reception of respective spaced apart inlet and outlet fluid conduit portions and wherein the volume of said fluid receptacle portion so defined is substantially less than the volume of said separable container and wherein said separable container includes a bottom wall portion with an upstanding surrounding side wall portion, said surrounding side wall portion presenting an inwardly disposed surrounding ledge means intermediately of the upstanding extent of same and wherein said closure includes peripheral rim means presented to said ledge means within said surrounding side wall portion whereby said fluid receptacle portion so defined is confined to that portion of said separable container extending therebelow.

7. A fluid trap according to claim 6 wherein gasket means is interposed between said ledge means and said rim means whereby a peripheral seal is established therebetween.

8. A fluid trap according to claim 6 wherein inlet and outlet fluid conduit portions are provided and wherein said inlet fluid conduit portion is so disposed as to project downwardly below said closure into said fluid receptacle portion.

9. A fluid trap according to claim 8 wherein said spaced apart inlet and outlet fluid conduit portions slip fit into said respective inlet and outlet means and wherein means are provided for detachably securing said fluid conduit portions to said closure.

* * * * *